US011857051B2

(12) United States Patent
Bickford et al.

(10) Patent No.: US 11,857,051 B2
(45) Date of Patent: Jan. 2, 2024

(54) COMPOSITION DISPENSER APPLICATOR WITH DYNAMICALLY ADJUSTABLE PROTRUSIONS, BRISTLES OR TINES, AND METHOD OF USE

(71) Applicant: L'OREAL, Paris (FR)

(72) Inventors: William Robert Bickford, Scotch Plains, NJ (US); Jason Fyfe, Holmdel, NJ (US); Andrea Saverino, Colts Neck, NJ (US); Oliver Sha, Fort Lee, NJ (US)

(73) Assignee: L'Oreal, Paris (FR)

( * ) Notice: Subject to any disclaimer, the term of this patent is extended or adjusted under 35 U.S.C. 154(b) by 207 days.

(21) Appl. No.: 17/007,940

(22) Filed: Aug. 31, 2020

(65) Prior Publication Data

US 2022/0061488 A1 Mar. 3, 2022

(51) Int. Cl.

| | |
|---|---|
| ***A45D 19/02*** | (2006.01) |
| ***A46B 11/06*** | (2006.01) |
| ***A46B 9/00*** | (2006.01) |

(52) U.S. Cl.

CPC ..... *A45D 19/02* (2013.01); *A46B 9/005* (2013.01); *A46B 11/06* (2013.01); (Continued)

(58) Field of Classification Search

CPC .... A45D 19/00; A45D 19/02; A45D 19/0041; A45D 19/005; A45D 19/0066; A45D 19/26; A45D 19/028; A45D 2019/0033; A45D 2200/054; A45D 2200/25; A45D 24/22; A45D 34/00; A45D 34/042; A45D 40/0075; A45D 40/20; A46B 11/00; (Continued)

(56) References Cited

U.S. PATENT DOCUMENTS 1,684,358 A 9/1928 Mosquera
6,505,986 B1 * 1/2003 Oder ..... A45D 24/26 222/211

(Continued)

FOREIGN PATENT DOCUMENTS

DE 3232227 A1 3/1984
EP 1839521 B1 6/2009

(Continued)

OTHER PUBLICATIONS

KR200289112Y1. Machine Translation (Year: 2002).*

(Continued)

*Primary Examiner* — Cris L. Rodriguez
*Assistant Examiner* — Karim Asqiriba
(74) *Attorney, Agent, or Firm* — Christensen O'Connor Johnson Kindness PLLC

(57) ABSTRACT

A composition dispenser with dynamically adjustable protrusions/bristles for delivery of a cosmetic composition to a substrate, particularly hair coloring agents. The composition dispenser comprises a protrusion unit including one or more protrusion elements and at least one dispensing orifices appointed for fluidic communication with a formulation reservoir. The protrusion unit is operably coupled to a length-adjustment element configured to adjust an exposed protrusion length of the protrusion elements along a direction perpendicular to a rotation plane of the length-adjust element.

13 Claims, 7 Drawing Sheets

(52) U.S. Cl.
CPC .... *A45D 2200/054* (2013.01); *A45D 2200/25* (2013.01); *A46B 2200/10* (2013.01)

(58) Field of Classification Search
CPC ..... A46B 11/001; A46B 11/0006; A46B 11/0017; A46B 11/0041; A46B 11/0031; A46B 11/0062; A46B 11/0065; A46B 11/0082
See application file for complete search history.

(56) References Cited

U.S. PATENT DOCUMENTS

| | | | | |
|---|---|---|---|---|
| 7,000,618 | B2 | 2/2006 | Dovergne et al. | |
| 8,220,469 | B1 * | 7/2012 | Spagnuolo | A46B 11/0041 401/28 |
| 9,364,068 | B2 | 6/2016 | Kodama | |
| 2002/0014246 | A1 | 2/2002 | Choi | |
| 2003/0041869 | A1 | 3/2003 | Dovergne et al. | |
| 2011/0041863 | A1 * | 2/2011 | Roualdes | A45D 24/22 132/114 |
| 2012/0093567 | A1 * | 4/2012 | Kravchenko | A45D 40/262 401/143 |
| 2015/0003886 | A1 | 1/2015 | Gallardo et al. | |
| 2015/0101630 | A1 | 4/2015 | Kodama | |
| 2019/0313766 | A1 * | 10/2019 | Perl | A45D 34/00 |
| 2020/0359765 | A1 * | 11/2020 | Sierra | A45D 24/28 |
| 2022/0079852 | A1 * | 3/2022 | Hartsell | A45D 34/042 |
| 2022/0202160 | A1 * | 6/2022 | Chalke | A45D 24/10 |
| 2022/0232946 | A1 * | 7/2022 | Cui | A46B 11/0013 |

FOREIGN PATENT DOCUMENTS

| | | | | |
|---|---|---|---|---|
| FR | 2828999 | A1 | 3/2003 | |
| JP | 6280125 | A2 | 10/1994 | |
| JP | 2002191427 | A | 7/2002 | |
| JP | 4721511 | B2 | 7/2011 | |
| JP | WO2015037694 | A1 | 3/2017 | |
| KR | 200289112 | Y1 * | 9/2002 | A45D 19/02 |
| KR | 200289112 | Y1 | 9/2002 | |
| KR | 101315538 | B1 | 10/2013 | |
| WO | 2015/037694 | A1 | 3/2015 | |

OTHER PUBLICATIONS

French Search Report and Written Opinion dated Jun. 18, 2021 in French Patent No. 2010290, pages.
International Search Report and Written Opinion dated Oct. 26, 2021, issued in corresponding international Application No. PCT/US2021/045509, filed Aug. 11, 2021, 15 pages.

* cited by examiner

C1 - Internal use

COMPOSITION DISPENSER APPLICATOR WITH DYNAMICALLY ADJUSTABLE PROTRUSIONS, BRISTLES OR TINES, AND METHOD OF USE

SUMMARY

The subject invention is directed to an adjustable composition dispenser/applicator with one or more protrusions, bristles or tines for adjustment in delivery of a cosmetic composition utilizing a double twist or threaded configuration for axial linear travel perpendicular to a rotation plane. Cosmetic compositions contemplated include, but are not limited to, hair color/lighting formulations, hair treatments, hair styling products, skin treatments, lotions, serums and/or acne-treatment formulations. The subject applicator includes composition dispenser/applicator assembly that can be dynamically adjusted by a user or consumer to change the length of protrusions or contact elements, such as cellular, centered and/porous materials, bristles or tines, or microderm contact elements to fit the task required cosmetic application.

In one aspect, a composition dispenser is provided comprising a protrusion unit including one or more protrusion elements and at least one dispensing orifices appointed for fluidic communication with a formulation reservoir. The protrusion unit is operably coupled to a length-adjustment element configured to adjust an exposed protrusion length of the protrusion elements along a direction perpendicular to a rotation plane of the length-adjust element. Preferably, the length-adjustment element comprises a twist top and a threaded insert comprising a top flange having a central opening and an outer and an inner threaded surface, wherein the protrusion unit is received within the threaded insert.

In one aspect, the protrusion unit includes one or more small bump operable to engage with one or more divet located on a collar of the twist top lock the twist top into place at a select exposed protrusion length of the protrusion elements. Preferably, a visual descriptor is provided local to the twist top indicating the exposed protrusion length of the protrusion elements.

The one or more protrusion elements may be a plurality of bristles, particularly having application in applying a hair coloring/lightening composition to hair. The exposed protrusion length is of sufficient length to separate hair strands and deposit a hair treatment formulation for achieving hair coloration and/or lightening. Alternatively, the one or more protrusion elements comprise a cellular, centered or porous material. In one aspect, the one or more protrusion elements are removable, and/or replaceable. The one or more protrusion elements may be selected from bristles, microneedles, prongs and tines. A gasket or seal is preferably coupled between the protrusion unit and the length-adjustment element. In operation, the protrusion unit rotates along the rotation plane as the length-adjustment element rotates along the rotational plane and moves upward and downward perpendicular to the rotation plane to adjust the exposed protrusion length. Conversely, the protrusion unit does not move upward and downward perpendicular to the rotation plane but rotates along the rotational plane.

In another aspect, a composition dispenser kit is provided. The kit comprises a bristle unit including one or more bristle elements and at least one dispensing orifices appointed for fluidic communication with a formulation reservoir. The bristle unit is operably coupled to a length-adjustment element configured to adjust an exposed bristle length along a direction perpendicular to a rotation plane of the length-adjust element. One or more formulation reservoir is provided for mountable attachment. Preferably, the formulation reservoir comprises a hair coloring or lightening formulation.

Another aspect provides a method of using a composition dispenser to apply a hair color formulation to the hair. The method comprises the steps of: mounting a bristle unit including a plurality of bristles and at least one dispensing orifices for fluidic communication on a formulation reservoir; rotating a length-adjustment element operably coupled to the bristle unit along a direction perpendicular to a rotation plane of the length-adjust element to adjust to an exposed bristle length; applying the hair color formulation to the hair, wherein the exposed bristle length is of sufficient length to separate hair strands and deposit the hair color formulation to the hair for achieving hair coloration and/or lightening.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
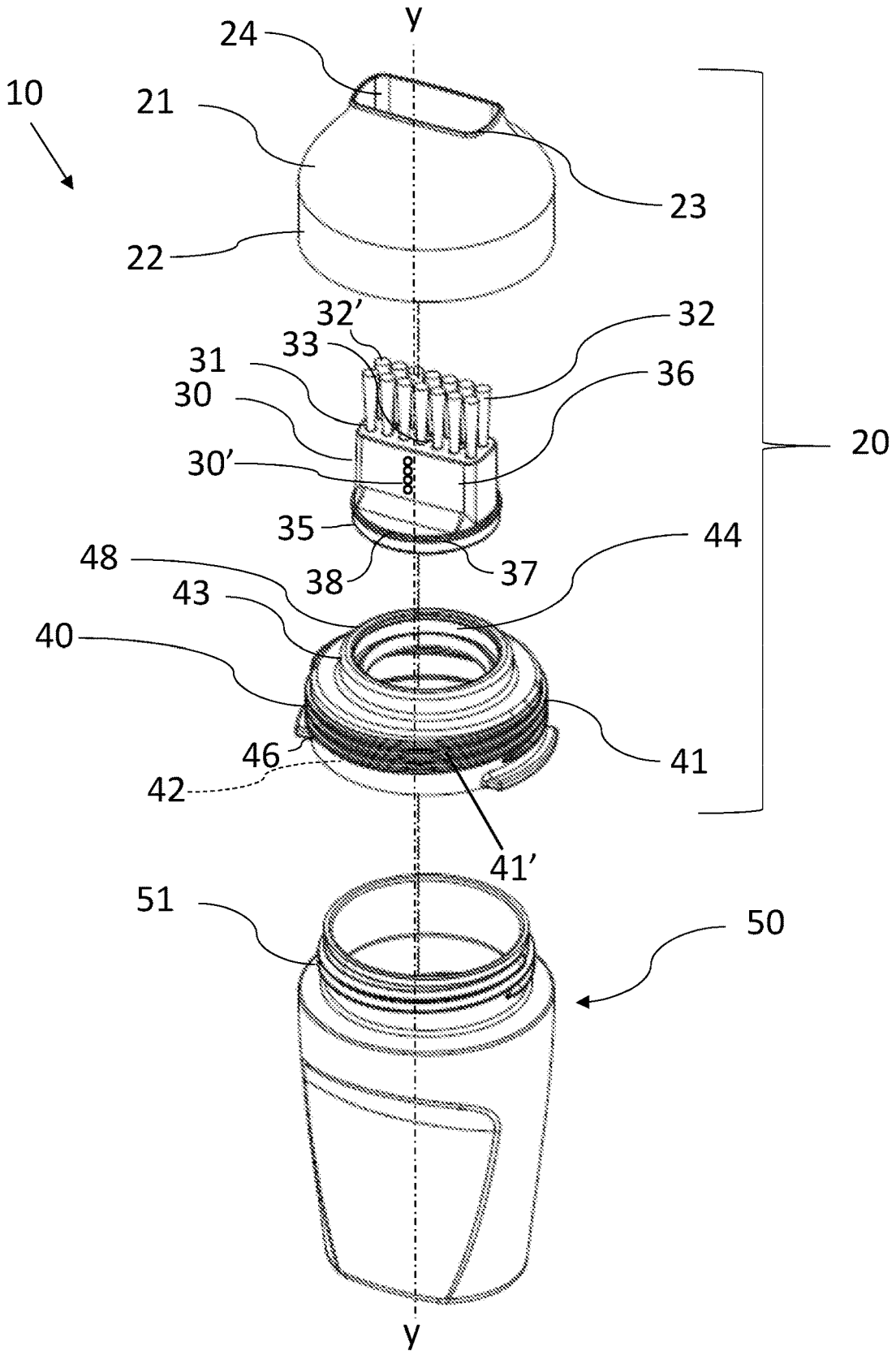
FIG. 1 shows a schematic view of the assembly of the composition dispenser/applicator for fluidic communication with a formulation reservoir.

Disclosed herein are adjustable composition dispensers, cosmetic compositions, kits with adjustable composition dispensers, methods of use, and the like. Cosmetic compositions include, among other things, hair coloration packages/compositions, hair styling products, skin care application (cleansing, anti-acne) or foundation and concealer applications. Dynamic adjustment of the bristles and/or tines of the composition dispenser is carried out by axial linear travel through use of a double twist configuration. Axial linear travel provides contemporaneous rotation along the x-axis or horizontal/rotational plane transferring to linear travel along the perpendicular y-axis or vertical plane. This is carried out by a consumer in order to enable rotational and perpendicular movement to change the exposed length/surface area of the bristles or tines in order to fit the task required. The adjustable composition dispenser can be twisted up or down to create bristle or tine lengths that match the hair on the head or face for accurate, clean and precise dispersion. For example, when coloring or treating beard hair, facial hair, and/or short scalp hair, the composition dispenser can be adjusted so that the bristles or tines extending from the applicator are short in length, having a decreased application surface area, to accommodate the short hair length for improved application of the hair color composition or treatment. Conversely, when coloring or treating longer hair, for example scalp hair, the user can adjust the composition dispenser so that a greater amount of the bristles or tines are exposed, presenting longer and providing a greater surface area for interacting with the hair and applying the hair color or hair treatment composition. Thus, the subject composition dispenser allows the user to customize the applicator bristle length exposed for their unique application (i.e. hair and/or beard).

In one aspect, an adjustable applicator/composition dispenser hair coloration package or kit is provided that comprises, among other things, a first container containing one or more alkalizing solution, optionally including alkalizing agents, hair treatment components such as oils, conditioners, dyes and/or pigments, a second container containing an oxidizing agent/developer adapted to be mixed in the first/second container before application, and an composition dispenser assembly with dynamically adjustable bristles or tines. Bristle or tine length is adjusted by the user to accommodate his/her hair length. After mixing the alkalizing agent and oxidizing agent/developer, the composition dispenser assembly is screwed on or mounted onto the top of the bottle for cleanly and accurately dispensing the hair color composition onto at least one hair length region, and preferably, to at least a second hair length region.

For example, both the user's scalp hair and beard can be treated with the hair color composition through adjustment of the composition dispenser "dialed" to accommodate the different hair lengths and/or types (straight or curly, for non-limiting example). The subject adjustable composition dispenser assembly and/or the bottle container associated therewith, can be used, cleaned, and refilled and/or reused. As a result, in an embodiment, the kit includes a non-monodose package for permanent hair coloration. The length of protrusion exposed commemorates with the hair length, where the length of the exposed protrusion is of sufficient length to deposit the hair color composition onto the hair without clumping User adjusts length so as to provide sufficient protrusion for application of formula to separate hair in sections creating uniform space for delivery, allowing a user to have the dispensing orifice closer to the hair surface. For example, for longer hair, a greater amount of the protrusion element length is exposed, but for shorter hair, such as for beard, eyebrows, etc., a shorter length of protrusion element is exposed.

The subject adjustable head assembly hair coloration package provides a wide opening for filling one or more coloration formula components. Preferably, the wide opening has a diameter ranging from about 1 inch to about 4 inches. After adding the oxidizing agent/developer and the alkalizing agent together, the adjustable head assembly is mounted on the package/bottle to seal the bottle. In an embodiment, the container/bottle's large opening is covered with a shipping cap or removable lidding (to cover a formula component, for example) before first use.

The adjustable composition dispenser assembly can be twisted up or down to create bristle or tine lengths that match the hair on the head or face for accurate, clean and precise dispersion. In an embodiment, the applicator surfaces include plastic tines, bristles or bristle clusters, non-woven materials, open cell materials such as foams, or other applicator materials common to the cosmetic industry. In an embodiment, the package/or kit is designed to allow the user to remove the cap via threaded closure. Preferably, a stopping/orienting bump or tab feature is provided that engages with the bottle to "lock" the composition dispenser assembly in place when it is mounted on the bottle to ensure that the bottle does not accidentally open when the composition dispenser assembly is being twisted to adjust the bristle or tine length exposed or projecting from the composition dispenser assembly. This stopping/orienting bump or tab is disengaged when the consumer cleans, refills and therefore reuses the package.

The subject composition dispenser and container/bottle is preferably re-useable; wherein re-usable hair color packages are provided for mixing in the assembly's bottle. Due to the re-usable aspect, the subject adjustable composition dispenser assembly and bottle are preferably composed of high quality materials. Ergonomic qualities also result due to the wider package/bottle top and composition dispenser assembly for ease of application, different grip and application angle, and effective application vectors/angles. The container/bottle and adjustable composition dispenser assembly are composed of materials chemically resistant to hair colorant ingredients. Preferably, the container/bottle and adjustable composition dispenser assembly is composed of olefins such as polypropylene and polyethylene. Alternatively, the container/bottle is composed of glass and/or metal (ex. formed steel or aluminum cans with coating or anodization).

Figure 2:
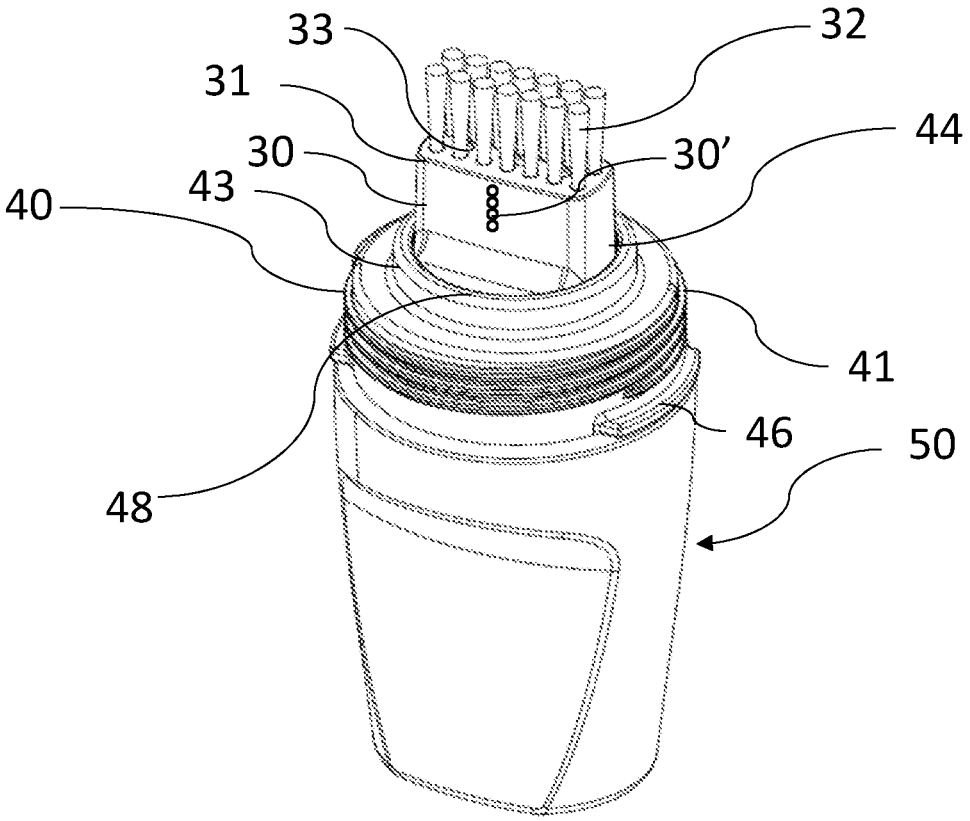
FIG. 2 shows a top plan view of the composition dispenser of FIG. 1 with the protrusion unit operably coupled to the length-adjustment element.
Figure 3:
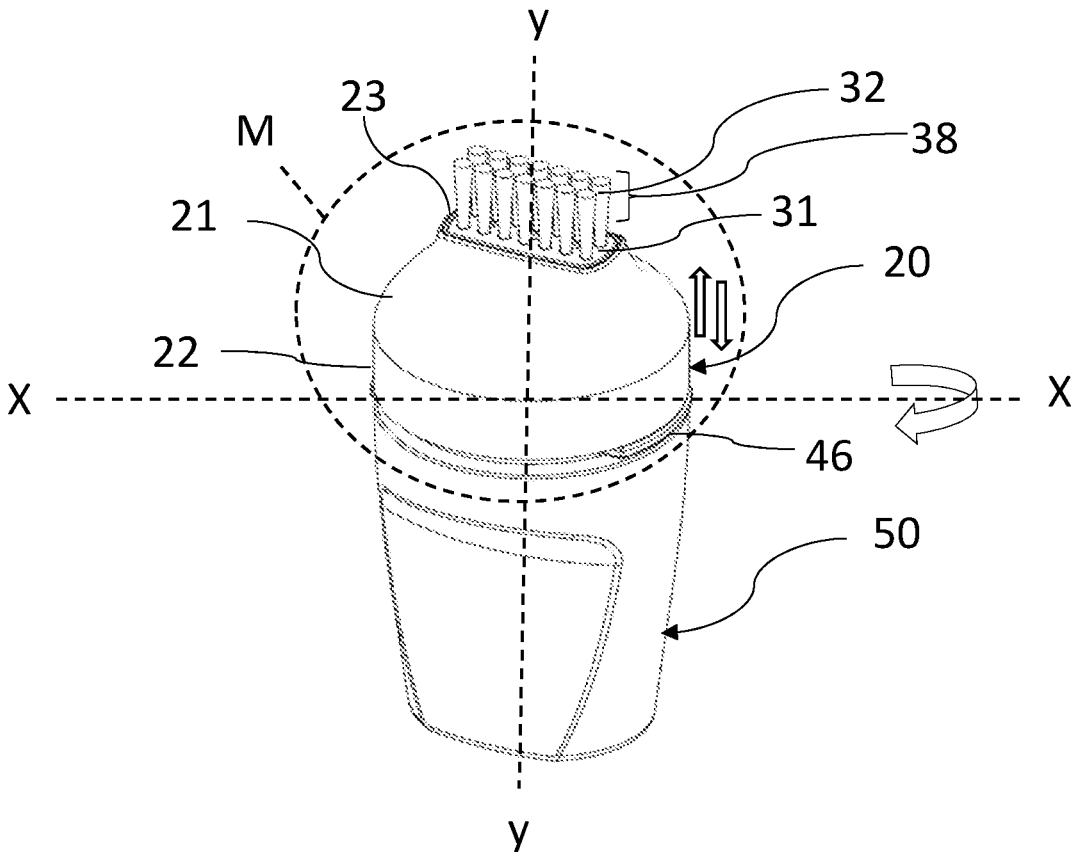
FIG. 3 shows a top plan view of the assembled composition dispenser of FIG. 1 on the formulation reservoir.
Figure 4:
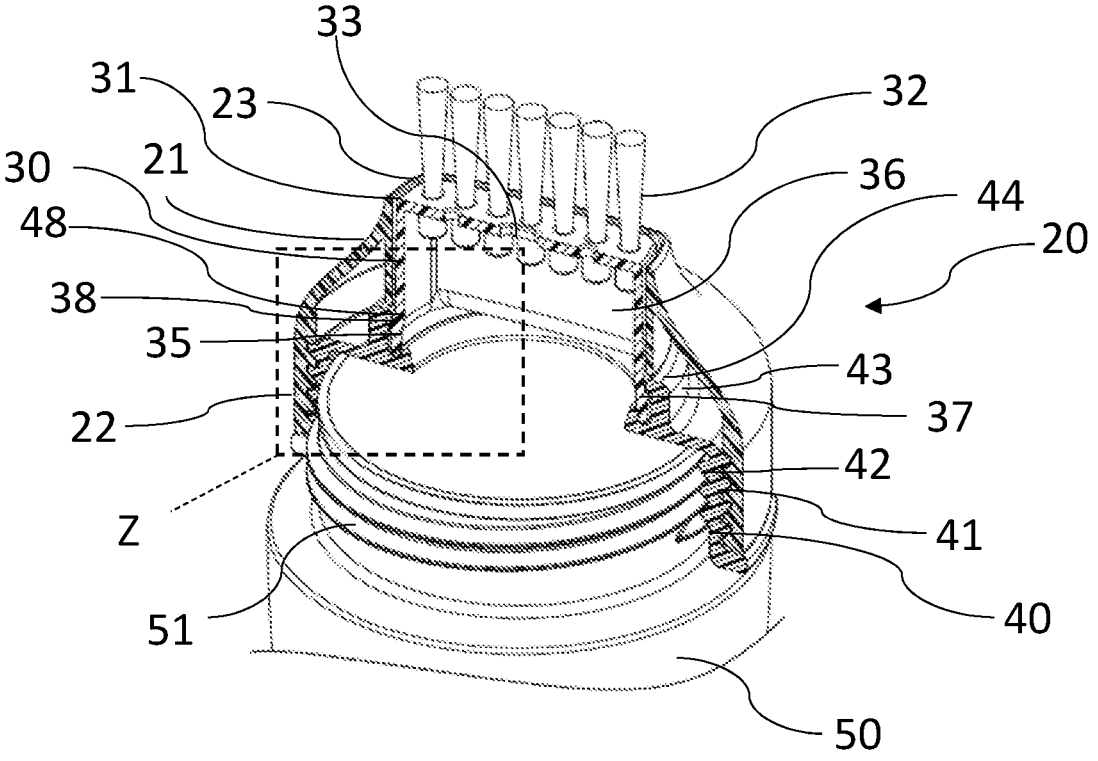
FIG. 4 is an exploded view taken along cross-sectional M of FIG. 3.
Figure 5:
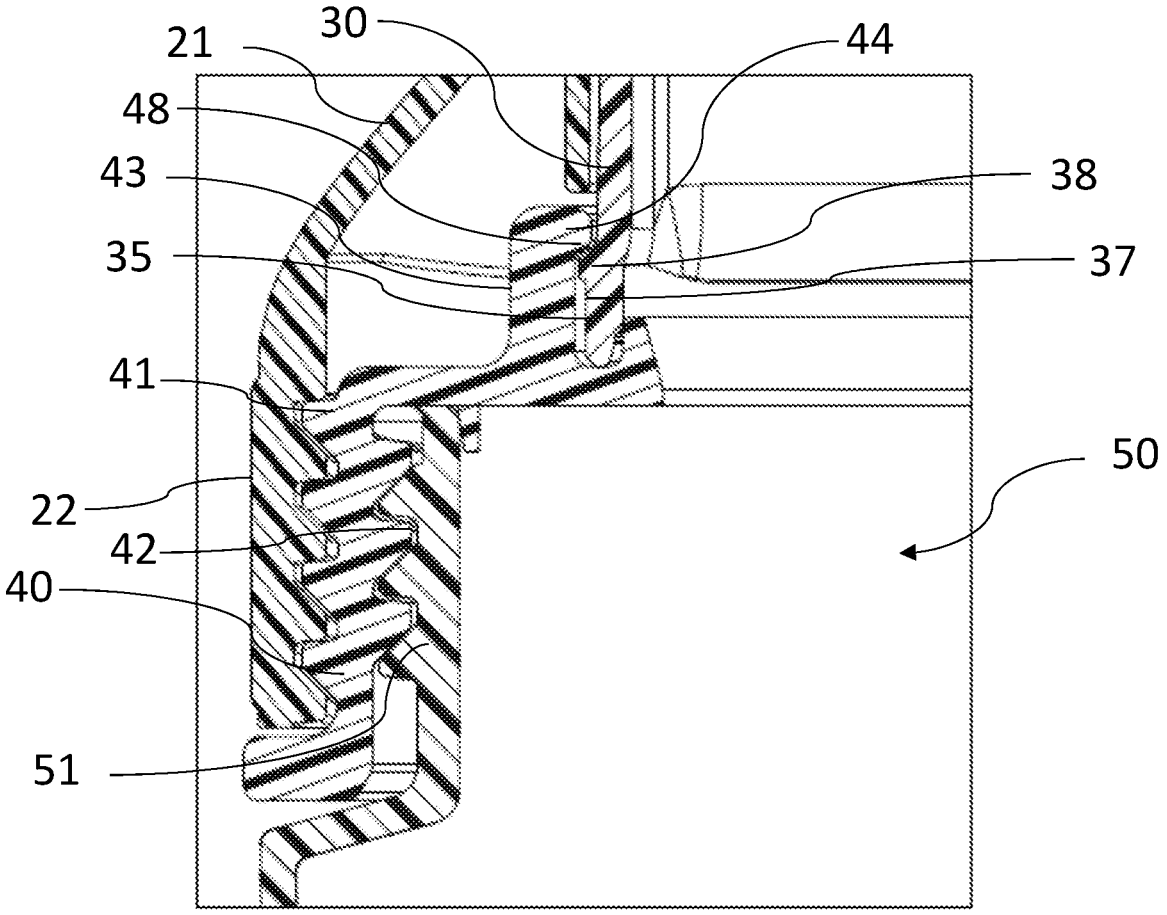
FIG. 5 is an exploded view taken along cross-section Z of FIG. 4.
Figure 6:
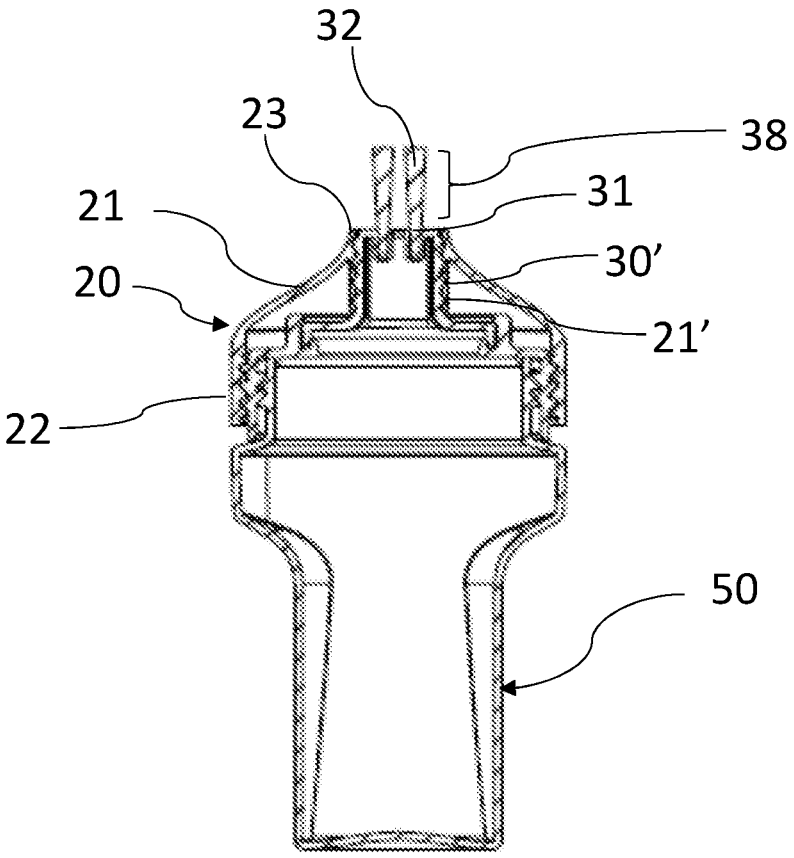
FIG. 6 is a side view taken along cross-section Y of FIG. 1.
Figure 7:
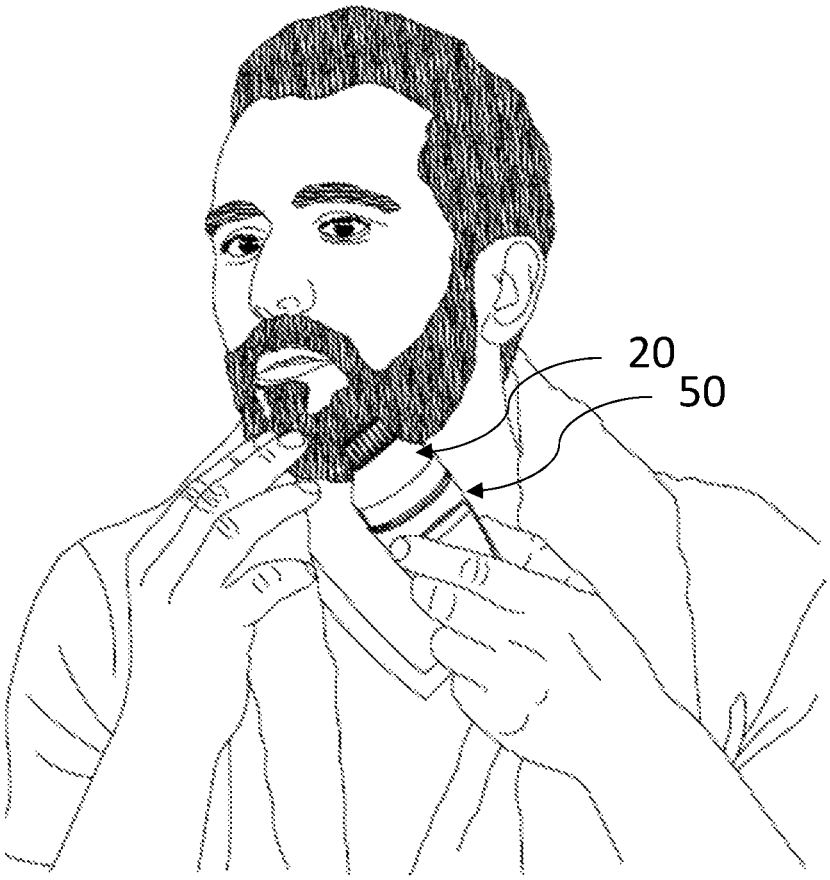
FIG. 7 shows a view of the assembled composition dispenser of FIG. 1 being used.

FIGS. 1-7 show views of a representative embodiment of an applicator with dynamically adjustable bristles and container in accordance with an aspect of the present disclosure. FIG. 1 shows a schematic view of the assembly of the composition dispenser/applicator for fluidic communication with a formulation reservoir. FIG. 2 shows a top plan view of the composition dispenser of FIG. 1 with the protrusion unit operably coupled to the length-adjustment element. FIG. 3 shows a top plan view of the assembled composition dispenser of FIG. 1 on the formulation reservoir. FIG. 4 is an exploded view taken along cross-sectional M of FIG. 3. FIG. 5 is an exploded view taken along cross-section Z of FIG. 4. FIG. 6 is a side view taken along cross-section Y of FIG. 1. FIG. 7 shows a view of the assembled composition dispenser of FIG. 1 being used.

Referring to FIGS. 1-7, composition dispenser assembly 20 with dynamically adjustable protrusions for delivery of a cosmetic composition is shown generally at 10. The composition dispenser is appointed to be removably attached to and/or mounted on a formulation reservoir, or container, shown herein as a bottle 50. The composition dispenser may be removed and/or replaced on different or new formulation reservoirs or bottles 50. It can be independent of the formulation reservoir or can be part of a kit. In use, a user may remove a lid from the formulations reservoir or bottle 50 and mount the composition dispenser on the bottle 50. Formulation reservoir, herein shown as a bottle 50, is adapted to contain and/or preferably contains a cosmetic composition. Cosmetic compositions may include, for non-limiting example, a skin treatment composition, a hair treatment composition, or a hair coloring composition. The adjustable composition dispenser may be part of a hair coloration kit or package, appointed to be removable mounted on bottle 50 containing the hair color or treatment formulation.

Adjustable composition dispenser comprises a protrusion unit 30 including one or more protrusion elements, herein shown as a bristle unit/bristle insert with a plurality of bristles or tines 32, and at least one dispensing orifices 33 appointed for fluidic communication with the formulation reservoir, or bottle 50. The protrusion unit 30 is operably coupled to a length-adjustment element formed by way of a twist top 21 in operable rotational movement with a threaded insert 40. Length-adjustment element is configured to adjust an exposed protrusion length of the protrusion elements/bristles 32 along a direction perpendicular to a rotation plane of the length-adjust element. The length-adjustment element comprises twist top 21 and threaded insert 40.

Protrusion unit 30 having one or more protrusions, herein shown as a bristle unit/bristle insert with a plurality of bristles or tines 32 is received within the twist top 21, and a threaded insert 40. Protrusion unit 30 may comprise a plurality of bristles or tines 32, as shown. Alternatively, the one or more protrusions may be composed of a cellular/centered or porous material for different applications and/or formulation delivery. The cellular, centered or porous material may be a pad or a plurality of pads or pad-like protrusions, and/or may be replaceable within the protrusion unit 30. The cellular, centered or porous material forming the protrusion or protrusions have particular application in delivery of formulations for skin care, including serums, lotions, anti-acne treatments, and/or photo protection (UV and/or UVA). Alternatively, the protrusions may be micro dermic contacts, abrasion surface or micro-derm needles, rather than bristles for skin treatment. Further, the protrusion may be part of or integrated within the protrusion unit 30, or may be separate, removable inserts that are replaceable.

Threaded insert 40 comprises a top flange 43, preferably flexible, with a central opening 44, an outer threaded surface 41 an outer threaded surface forming a length-adjusting element 41' and an inner threaded surface 42. The outer and inner threaded surfaces 41 and 42 respectively engage the twist top 21 and mating top of the formulation reservoir, shown herein as bottle top 51 of bottle 50. Protrusion unit 30 is inserts or snaps into central opening 44 of the threaded insert 40 and locks into rotational place on the horizontal plane or x-axis shown at x-x in FIG. 3, without allowing for vertical movement on the vertical plane perpendicular to the rotational plane, y-axis shown at y-y. Central opening 44 of top flange 43 includes an internal groove 47, extending substantially perpendicular toward central opening 44 and preferably substantially around central opening 44.

Twist top 21 is formed having threaded collar 22 for axial linear travel extending toward a top central opening 23 forming a cavity 24. Collar 22 of twist top 21 connects with outer threaded surface 41 of threaded insert 40. Twist top 21 may include one or more projections, bristles or tines proximal or integrated local to top central opening 23, but without obstructing top central opening 23. Preferably, however twist top 21 and collar 22 does not include any bristles or tines or protrusions. Bristles or tines 32, as shown, of protrusion insert/protrusion unit 30 pass through top central opening 23 of twist top 21, while protrusion unit 30 is housed therein twist top 21.

Protrusion unit 30 is constructed herein as a bristle insert, but may instead have one or more cellular, centered and/or porous material portions for different cosmetic applications as aforementioned. Protrusion unit 30 is constructed having a proximal end 31 including one or more protrusions extending therefrom, shown as bristles or tines 32, and at least one dispensing orifice 33 adapted for fluidic communication with formulation reservoir, shown as bottle 50, and a distal end 35, arranged to form a cavity 36. Preferably, a plurality of orifices 33, or small diameter apertures, are integrated in the top surface of proximal end 31, preferably centrally arranged between the bristles or tines 32. In an embodiment, bristles or tines 32 are formed as a plurality short stiff coarse hairs or filaments or prongs in clusters 32' having a length ranging from about 0.5 inches to about 4 inches. Proximal end 31 of protrusion unit 30 is shaped to align and be inserted and housed within top central opening 23 of twist top 21 so that the protrusions extend through the top central opening 23. Preferably, proximal end 31 and visa vie protrusions or bristles 32 and top central opening 23 is formed as a parallelogram, elongated rectangle for ergonomic applications, or of a semi-circle or a plane figure with at least one flat side. Alternatively, proximal end 31 and visa vie protrusions or bristles 32 and top central opening 23 is circular, and protrusion unit is fixed on the threaded unit while the twist top 21 rotates during axial linear travel along the rotational x-axis and vertical movement on the y-axis perpendicular to the rotation plane/x-axis.

Distal end 35 of protrusion unit 30 includes an insert collar 37 with a rim 38. Insert collar 37 with rim 38 is inserted within central opening 44 of top flange 43 by way of groove 47 to secure the protrusion unit 30 within central opening 44, while also preventing movement of the protrusion unit 30 on the vertical plane or y-axis/perpendicular to the rotational plan (horizontal plane x-axis/rotational plane x-x). The y-axis herein or vertical plane extends centrally through centerline (y-y) of the assembly 20. A seal 49 (see FIG. 5) is preferably provided between groove 47 and insert collar 37 providing three points of contact to prevent liquid and/or gas from escaping from the assembly. Rim 38 of insert collar 37 engages and abuts a circumferential ledge 48 extending along the entire circumference of central opening 44 of top flange 43.

Threaded insert 40 is screwed onto bottle 50, and locks in place. Protrusion unit 30 is snapped into the threaded insert 40 and is capable of twisting or rotational movement along the horizontal plane or y-axis, but is not capable of vertical or up and down movement on the vertical plane or x-axis. As a result, twist top 21 and protrusion insert 30 rotate together, but only twist top 21 is capable of movement on the vertical plane or y-axis, perpendicular to the rotation plane (x-axis), thereby adjusting the amount of protrusion or bristles 32 exposed from twist top 21.

Circumferential ledge 48 abuts rim 38 preventing rim 38 from movement upward/downward on the vertical plane. Conversely, circumferential ledge 48 abutting rim 38 allows rim 38 of protrusion insert 30 to rotate along circumferential ledge 48 as twist top 21 is turned. As twist top 21 is turned or rotated the twist top 21 is dynamically adjusted upward and downward on the vertical plane while the bristle insert 30 is prevented from upward and downward movement. As a result, the surface area of the protrusion/bristles or tines 32 projecting from twist top 21 increases and/or decreases, depending on the rotation of the twist top 21. Threaded insert 40 further includes one or more lateral locking tabs 46 to lock the threaded insert on the bottle 50, which includes mating grooves adapted to receive the tabs 46. Tabs may be squeezed to release the threaded insert from the bottle 50. Tabs 46 engage an internal lock tab to prevent the assembly head from inadvertently being removed from the bottle during rotation of the twist top 21.

Preferably, the protrusion unit 30 includes one or more small bump/s 30' operable to engage with one or more divet 21' located on the twist top 21 to lock the twist top into place at a select exposed protrusion length of the protrusion elements. (See, FIG. 6). Preferably, a visual descriptor is provided local to the twist top indicating the exposed protrusion length of the protrusion elements. Small bumps 30' may be provided on the protrusion unit 30 to engage with divets/dimples 21' located on twist top 21, fitting into the divets/dimples 21' to create a click or soft lock of twist top 21 into place and visa via lock the exposure length of the bristles for use. Visual descriptor may include a label or an emboss/deboss of symbols or measure lengths of 1 mm, 3 mm, 5 mm, and/or images (hair, beard) proximal to the twist top 21 to define the bump position to the user.

Twist top 21 is preferably composed of polypropylene (PP), while protrusion insert 30, threaded insert 40 and/or bottle 50 are composed of engineered polyethylene (PE) resin. Bristles or tines 32 are preferably composed of a polyester or nylon material. Bottle 50 may include a shipping cap for removal when in use with the adjustable composition dispenser 20.

A kit or package may be provided with an adjustable composition dispenser mounted on a container containing an oxidizing agent with hair coloration agent, along with a developer bottle. In an embodiment, during operation, the dial on the applicator is adjusted to the user's ideal hair length—level 1 (for example, for beard application, eyebrow application, or the like). Next, the developer is added to the container, and the composition dispenser assembly is returned onto the container and the composition mixed and applied to the beard. The dial of the adjustable composition dispenser is then rotated or dialed to a larger bristle length, and the composition is applied to the scalp hair.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "back," "upward," "downward," "right hand," "left hand," "lateral," "medial," "in," "out," "extended," "advanced," "retracted," "proximal," "distal," "central," etc. These references, and other similar references in the present application, are only to assist in helping describe and understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A composition dispenser, comprising:

a protrusion unit including one or more protrusion elements and at least one dispensing orifices configured for fluidic communication with a formulation reservoir;

the protrusion unit operably coupled to a length-adjustment element configured to adjust an exposed protrusion length of the protrusion elements along a direction perpendicular to a rotation plane of the length-adjust element, wherein the length-adjustment element comprises a twist top and a threaded insert comprising a top flange having a central opening and an outer and an inner threaded surface, wherein the protrusion unit is received within the threaded insert, wherein the top flange comprises a circumferential ledge extending inward toward the central opening, a collar on the bottom side of the protrusion unit fits in the central opening, and a rim extending outward on the collar rotates below the circumferential ledge.

2. The composition dispenser of claim 1, wherein the protrusion unit includes one or more small bump operable to engage with one or more divet located on the twist top lock the twist top into place at a select exposed protrusion length of the protrusion elements.

3. The composition dispenser of claim 2, wherein a visual descriptor is provided local to the twist top indicating the exposed protrusion length of the protrusion elements.

4. The composition dispenser of claim 1, wherein the one or more protrusion elements comprise a plurality of bristles.

5. The composition dispenser of claim 1, wherein the one or more protrusion elements comprise a cellular, centered or porous material.

6. The composition dispenser of claim 1, wherein the one or more protrusion elements are removable.

7. The composition dispenser of claim 1, wherein the one or more protrusion elements are selected from bristles, microneedles, prongs and tines.

8. The composition dispenser of claim 1, wherein the protrusion length is of sufficient length to separate hair strands and deposit a hair treatment formulation for achieving hair coloration and/or lightening.

9. The composition dispenser of claim 1, wherein the protrusion unit rotates along the rotation plane as the length-adjustment element rotates along the rotational plane, and the length-adjustment element moves upward and downward perpendicular to the rotation plane to adjust the exposed protrusion length.

10. The composition dispenser of claim 9, wherein the protrusion unit does not move upward and downward perpendicular to the rotation plane but rotates along the rotational plane during rotation of the length adjustment element.

11. A composition dispenser kit comprising:

the composition dispenser of claim 1; and a bottle to which the composition dispenser locks onto, wherein the bottle includes a formulation.

12. The composition dispenser kit of claim 11, wherein the formulation comprises a hair coloring or lightening formulation.

13. A method of using a composition dispenser of claim 1 to apply a hair color formulation to the hair, comprising:

mounting a composition dispenser of claim 1 onto a bottle, and locking the one or more locking tabs onto the bottle;

rotating the length-adjustment element operably coupled to the protrusion unit along a direction perpendicular to a rotation plane of the length-adjustment element to adjust to an exposed bristle length;

applying the hair color formulation to the hair, wherein the exposed bristle length is of sufficient length to separate hair strands and deposit the hair color formulation to the hair for achieving hair coloration and/or lightening.

* * * * *